US010210692B2

(12) United States Patent
Hayashi

(10) Patent No.: US 10,210,692 B2
(45) Date of Patent: Feb. 19, 2019

(54) COIN STORAGE CASSETTE

(71) Applicant: NIPPON CONLUX CO., LTD., Saitama (JP)

(72) Inventor: Takahiro Hayashi, Saitama (JP)

(73) Assignee: Nippon Conlux Co., Ltd., Sakado-shi, Saitama (JP)

( * ) Notice: Subject to any disclaimer, the term of this patent is extended or adjusted under 35 U.S.C. 154(b) by 0 days.

(21) Appl. No.: 15/516,377

(22) PCT Filed: Dec. 10, 2014

(86) PCT No.: PCT/JP2014/082715
§ 371 (c)(1),
(2) Date: Mar. 31, 2017

(87) PCT Pub. No.: WO2016/042682
PCT Pub. Date: Mar. 24, 2016

(65) Prior Publication Data

US 2017/0345242 A1 Nov. 30, 2017

(30) Foreign Application Priority Data

Sep. 18, 2014 (JP) ..... 2014-190021

(51) Int. Cl.
*G07D 9/06* (2006.01)
*G07D 1/00* (2006.01)
(Continued)

(52) U.S. Cl.
CPC ..... *G07D 1/00* (2013.01); *G07D 9/00* (2013.01); *G07D 9/06* (2013.01); *G07F 9/10* (2013.01); *G07F 11/46* (2013.01)

(58) Field of Classification Search
CPC .. G07D 9/06; G07D 1/00; G07D 9/00; G07D 9/10; G07D 11/46
(Continued)

(56) References Cited

U.S. PATENT DOCUMENTS 5,944,601 A * 8/1999 Hayashi ..... G07D 1/00 221/24
6,086,473 A * 7/2000 Hayashi ..... G07D 1/00 220/23.4
(Continued)

FOREIGN PATENT DOCUMENTS

GB 4003 A 10/1912
GB 4008 A 10/1912
(Continued)

OTHER PUBLICATIONS

International Search Report dated Feb. 10, 2015 related to PCT Application No. PCT/JP2014/082715.
(Continued)

*Primary Examiner* — Jeffrey A Shapiro
(74) *Attorney, Agent, or Firm* — Dergosits & Noah LLP

(57) ABSTRACT

Provided is a coin storage cassette capable of preventing a coin payout failure without requiring a change in the structure of conventional coin handling apparatuses, even when an adapter tube for changing the apparent inner diameter of a coin tube is mounted.
1: An upper rear notch 61 is formed on the back face side of the adapter tube 6, projection-shaped attachment portions 64 are formed on opposing outside portions of the adapter tube 6, and groove-shaped attachment reception portions 32 are formed in the coin tube 21, each attachment portion 64 being engaged into a respective one of the attachment reception portions 32, and the attachment reception portions 32 restricting top-to-bottom and front-to-rear movement of the adapter tube 6; and the adapter tube 6 is detachable from the rear side of the coin storage cassette 1, while a cover 4 is widely opened. 2: The upper rear notch 61 is formed on the back face side of the adapter tube 6 so as to communicate with the upper edge, and a lower front notch 62 is formed on the front face side of the adapter tube 6 so as to communicate
(Continued)

with the lower edge, so that the +coins are guided backward in the upper edge and guided forward in the lower edge.

5 Claims, 17 Drawing Sheets

(51) Int. Cl.
*G07D 9/00* (2006.01)
*G07F 9/10* (2006.01)
*G07F 11/46* (2006.01)

(58) Field of Classification Search
USPC ..... 235/379; 453/61, 62
See application file for complete search history.

(56) References Cited

U.S. PATENT DOCUMENTS 6,264,546 B1* 7/2001 Iida ..... G07D 1/00 194/350
6,371,845 B1* 4/2002 Ishida ..... G07D 1/00 194/200
2002/0168931 A1* 11/2002 Nakajmima ..... A22C 21/06 452/120
2004/0198210 A1* 10/2004 Meyer-Weingaertner ..... G07D 1/00 453/17
2005/0159095 A1* 7/2005 Igusa ..... G07D 1/00 453/61
2007/0084909 A1* 4/2007 Quattrini ..... G07D 1/00 232/64
2008/0142335 A1* 6/2008 Nogin ..... G07D 1/00 194/302
2011/0076930 A1* 3/2011 Chang ..... G07D 1/00 453/18
2012/0309280 A1* 12/2012 Chang ..... G07D 1/00 453/18
2013/0205723 A1* 8/2013 Blake ..... G07F 9/08 53/473

FOREIGN PATENT DOCUMENTS

JP S55-86263 12/1953
JP 11-073543 3/1999
JP 3672705 4/2005
JP 4242786 7/2005
JP 2013-246509 12/2013
JP 2014-21600 A 2/2014

OTHER PUBLICATIONS

Written Opinion dated Feb. 10, 2015 related to PCT Application No. PCT/JP2014/082715.
English Abstract of Japanese Patent Application 2014-21600, Published Feb. 3, 2014.
English Abstract of Japanese Patent Application 2013-246509, Published Dec. 9, 2013.
English Abstract of Japanese Patent Application No. 09-234579; Publication No. 11-73543, Published Mar. 16, 1999.
English Abstract of Japanese Patent No. 55-86263.
English Abstract of Japanese Patent No. 3672705; Publication No. 11-086096 Published Mar. 30, 1999.
English Abstract of Japanese Patent No. 4242786; Publication No. 2005-202871, Published Jul. 28, 2005.
Supplemental Partial European Search Report dated Apr. 20, 2018 related to PCT Application No. PCT/JP2014/082715, 11 pages.
The extended European Search Report dated Aug. 24, 2018 related to PCT Application No. PCT/JP2014/082715, 10 pages.

* cited by examiner

COIN STORAGE CASSETTE

TECHNICAL FIELD

The present invention relates to a coin storage cassette which can be detachable to a coin handling apparatus mounted inside apparatuses such as a vending machine, a money-changer, and a service apparatus, in particular to a technology for adjusting inner diameter of a coin tube which stores coins of a plurality of denominations.

BACKGROUND ART

In general, a coin handling apparatus which determines authenticity of thrown coins to selectively store genuine coins according to denomination, and pays out the selectively stored coins as changes is mounted inside an apparatus such as a vending machine, a money-changer, and a service apparatus.

A detachable coin storage cassette (coin storage cassette, hereinafter) mounted to this coin handling apparatus is detachable to the coin handling apparatus, and is mainly constituted by a unit tube formed of a plurality of coin tubes which are arranged linearly and in parallel and have respectively different inner diameters, a coin base adhered to a lower region of the unit tube with screws, etc., and a payout slide which is slidably supported between the lower edge of the unit tube and the coin base and extracts the coins positioned in the lowest bottom layers of the plurality coin tubes one by one.

This coin storage cassette furthermore comprises latching mechanism for locking the upper portion of the coin storage cassette to the coin handling apparatus main body or releasing the upper portion from the main body, and a handle formed in the front face of the coin storage cassette so that fingers are inserted into the handle and hooked at the time of removing and mounting, and, the coin storage cassette can be removed while the coin handling apparatus is kept mounted to the apparatus, by the operation of the latching mechanism for releasing the connection between the coin handling apparatus main body and the coin storage cassette.

In contrast, in some conventional coin handling apparatuses, malfunction of coin handling apparatuses caused by human errors are prevented by arranging two detection means for detecting the setting state and the type of the coin storage cassette in the apparatus main body.

Furthermore, full state detection means having a lever protruding at the upper edge inside the coin tube is further arranged so that it can be detected when the coins stored inside the coin tube are full.

By the way, a coin storage cassette piles and stores coins in the above unit tube according to each denomination, and thus, exclusive coin tubes formed with the size according to the diameter and thickness of each stored denomination are respectively required.

Therefore, in the case of conventional coin storage cassettes, when they were used in various countries in the world where coin diameters were varied, or when combination of applied denomination was changed according to the purpose, as many integratedly formed unit tubes having respectively different inner diameters as the number of the corresponding countries and the purposes had to be manufactured.

Also, in the case of coin handling apparatus already mounted to a vending machine, etc. and used, when acceptable coins had to be changed, an integratedly formed unit tube having the inner diameter corresponding to the outer diameter of the changed coin had to be newly manufactured. These issues were the reasons for the increase of the cost for manufacturing coin handling apparatuses.

In contrast, instead of independently manufacturing integratedly formed unit tubes, it is technically known to store various coins by mounting a spacer inside the coin tube so that the inner diameter of the coin tube is changed.

For example, it is technically known to change the inner dimeter of the coin tube by inserting a cylindrical shaped adapter tube having a flange at its upper edge into each coin tube (Patent document 1: Japanese Patent No. 3672705).

However, in the art in Patent document 1, the adapter tube entirely covers the inner wall face of the coin tube at the mount reception side, and thus, a conventional coin handling apparatus fails to allow a lever of the full state detection means to intrude into the coin tube. Therefore, the coin handling apparatus main body needs to be improved.

Moreover, in the art in Patent document 1, due to the lack of means for restricting the upward movement of the adapter tube, unless the adapter tube is securely mounted to the coin tube, the coins may not be aligned and stored inside the coin tube and a payout failure may occur.

On the other hand, as an art in which the inner wall face of the coin tube is not entirely covered, it is technically known to guide stored coins toward the full state detection sensor side by the use of a spacer having a half-moon shaped cross section (Patent document 2: Japanese Patent No. 4242786). This art allows the distance between the store coins and the full state detection sensor to be maintained even after the spacer is mounted and, thereby the full state detection sensor can detect the stored coins.

However, in the art in the Patent document 2, since the spacer is mounted with an L-shaped hook, unless the spacer is securely mounted, the coins may not be aligned and stored inside the coin tube and a payout failure may occur.

Also, when coins with smaller diameter are guided toward the side where the full state detection sensor is arranged, the coins with small diameter are caught while standing at the hole for paying out coins, arranged in the coin base on the side where the full state sensor is arranged, and thereby, a coin payout failure may occur.

PRIOR ART DOCUMENTS

Patent Documents

Patent document 1: Japanese Patent No. 3672705
Patent document 2: Japanese Patent No. 4242786

SUMMARY OF INVENTION

Problems to be Solved by the Invention

Therefore, the present invention aims, in consideration of the above mentioned arts, at providing a coin storage cassette capable of preventing a coin payout failure without requiring a change in the structure of conventional coin handling apparatuses, even when an adapter tube for changing the apparent inner diameter of a coin tube is mounted.

Means to Solve the Problem

In order to solve the above problem, in the coin storage cassette in the present invention, the adapter tube has a substantially cylindrical shape and radial elasticity, on the back face side of which, an upper rear notch which is communicated with an upper edge is formed, and on opposing outsides of which at least one by one projection-shaped attachment portion is formed, and in the coin tube, grooved-shaped attachment reception portions into which each of the attachment portions is engaged, and which restrict top-to-bottom and front-to-rear movement of the adapter tube are formed. Thereby, while the cover is widely opened, the adapter tube is detachable from the back face side of the coin storage cassette.

Furthermore, in case where the adapter tube is not mounted to an appropriate position inside the coin tube, when the cover is closed, the cover may come into contact with the adapter tube to correct the position of the adapter tube into an appropriate position inside the coin tube.

Also, the adapter tube is substantially cylindrical-shaped, on the back face side of which an upper rear notch which is communicated with an upper edge is formed and in the front face side of which a lower front notch which is communicated with a lower edge is formed. It is configured so that, in the upper portion the coins are guided backward, in the lower portion the coins are guided forward, and an inclined portion where the direction in which the coins are guided is changed in the middle of the adapter tube is arranged.

Furthermore, a small cover which is continuous to the lower edge of the upper rear notch and openably/closably covers the back face side of the adapter tube may be arranged.

Also, a rectangular hole is formed on the back face side of the coin tube, and in the small cover of the adapter tube, a projection for detecting the adapter which is protrudingly provided backward and protrudes backward of the coin storage cassette through the rectangular hole is formed. It is also possible to configure so that, when the coin storage cassette is mounted to the coin handling apparatus, the projection for detecting the adapter can activate detecting means which is arranged in the coin handling apparatus and detects the type of the mounted coin storage cassette.

Effect of the Invention

As shown above, mounting the adapter tube to the coin tube by the engagement of the projection and the groove allows top-to-bottom and front-to-rear movement of the mounted adapter tube to be restricted, and thereby, the coins can be securely aligned and stored, and a payout failure can be prevented. Also, arranging the notch in the upper portion of the back face of the adapter tube avoids preventing the lever of the full state detection means from protruding into the coin tube and the adapter tube, and thereby, the coin handling apparatus does not have to be redesigned.

Furthermore, configuring so that the recess in the main body and the cover interpose the convex arranged in the adapter tube allows the adapter tube to be securely mounted to the coin tube.

Also, changing the direction in which the adapter tube guides the coins in the middle of the adapter tube so that the coins are guided backward in the upper portion and forward, namely to the direction opposite to the payout hole, in the lower portion, avoids impeding the movement of the lever of the full state detection means and allows the size ratio of the payout hole to coins to be lowered, and thereby can prevent the coins from being caught while standing at the payout hole.

Furthermore, constituting the back face side of the adapter tube with an openable/closeable small cover allows the coins inside the adapter tube to be collected from the back face side of the coin storage cassette, as well as the conventional unit tube.

Also, the presence of the adapter tube is automatically detected by the use of detecting means for detecting the type of a coin storage cassette, and thereby setting of the type of coins to be stored can be automatically switched without being influenced by human errors.

EMBODIMENT FOR IMPLEMENTING THE INVENTION

The explanation regarding one embodiment of the coin storage cassette in the present invention is given below referring to FIG. 1-FIG. 8.

It is noted that the configuration of the coin handling apparatus on which the coin storage cassette in the present invention is mounted is similarly to the configuration of the conventional coin handling apparatuses.

Figure 1:
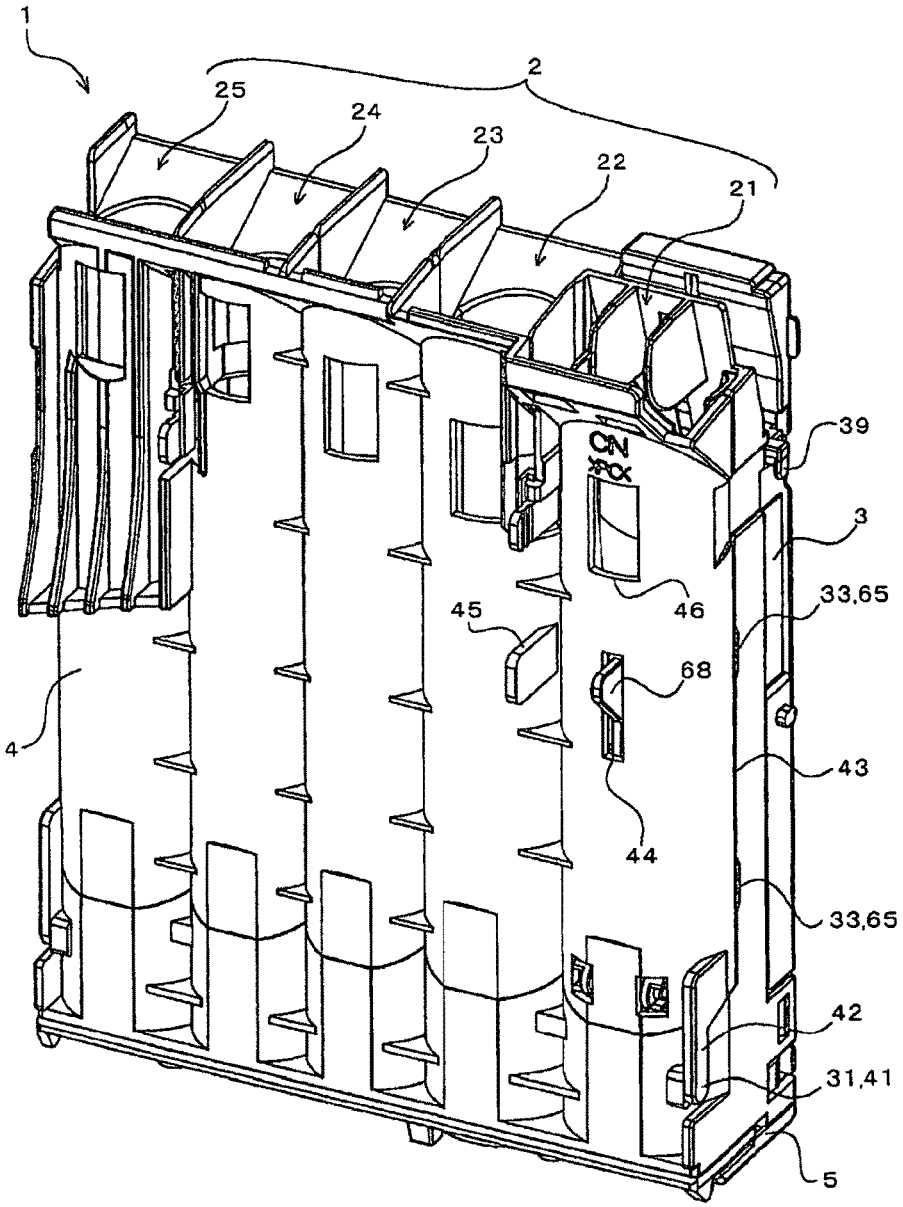
FIG. 1 is a back face side perspective mainly showing the configuration of the back face side of the coin storage cassette in the present invention.

FIG. 1 shows a back face side perspective of a coin storage cassette 1 in the present invention.

The coin storage cassette 1 is mainly constituted, as shown in FIG. 1, by a unit tube 2 formed of a plurality of coin tubes 21-25 arranged linearly and in parallel so that coins which drop from a coin selector 110 (see FIGS. 7A, 7B) are aligned, piled and stored, and a coin base 5 adhered to a lower region of the unit tube 2 with screws, etc.

The unit tube 2 is mainly constituted by a main body 3 which constitutes a front face side and a back face side lower portion of the unit tube 2, and a cover 4 which substantially entirely covers the back face of the unit tube 2 openably/closably.

Furthermore, the detachable adapter tube 6 for changing the inner diameter of a coin tube 21 is mounted to the coin tuber 21.

Also, it is noted that, in this embodiment, the adapter tube 6 is mounted only to the coin tube 21, but may be mounted to either of the other coin tubes 21-25, and also can be selectively mounted to the plurality of coin tubes 21-25.

Figure 2A:
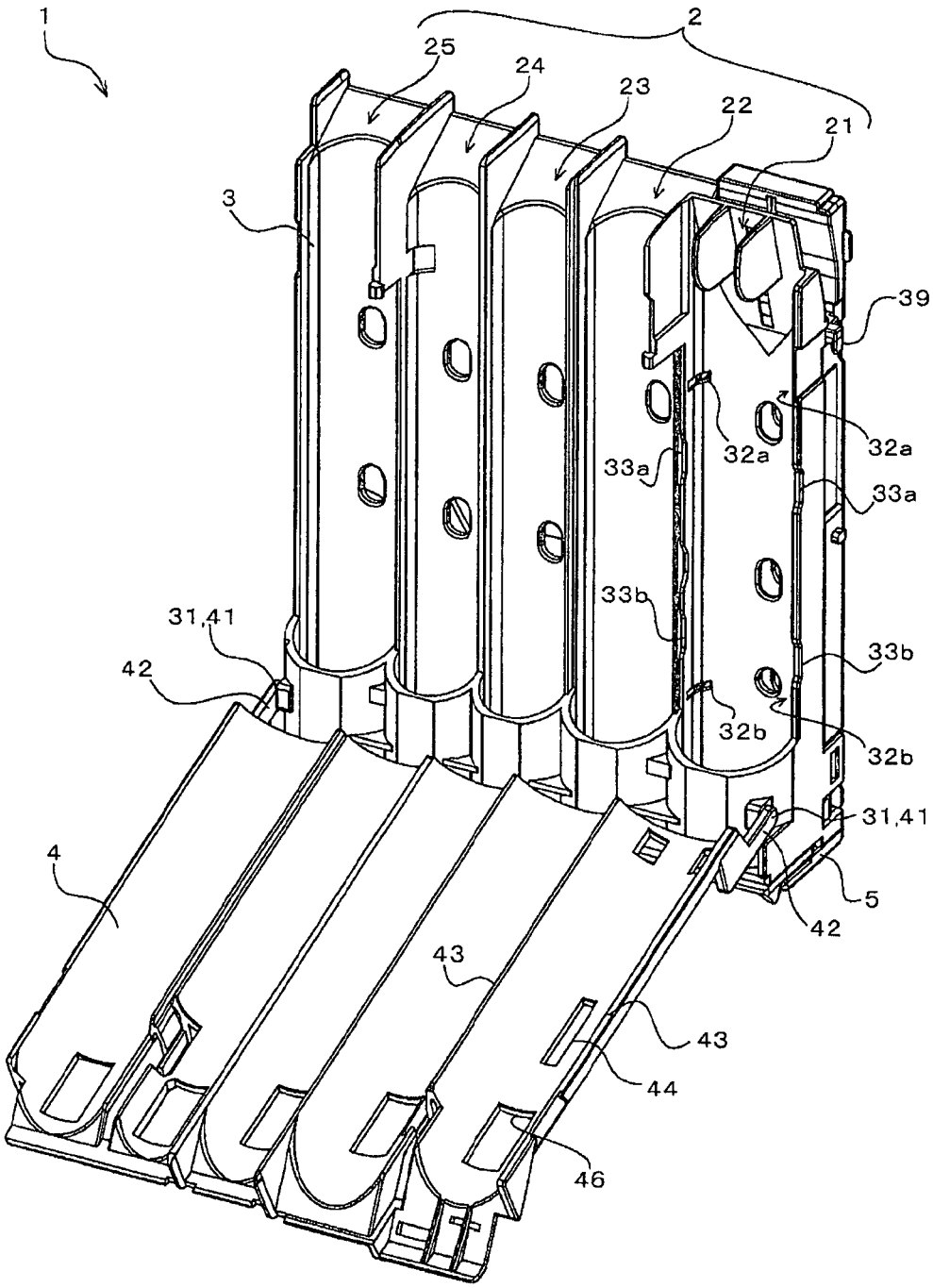
FIG. 2A is a back face side perspective showing, in FIG. 1, the state where the cover is widely opened and the adapter tube is removed.
Figure 2B:
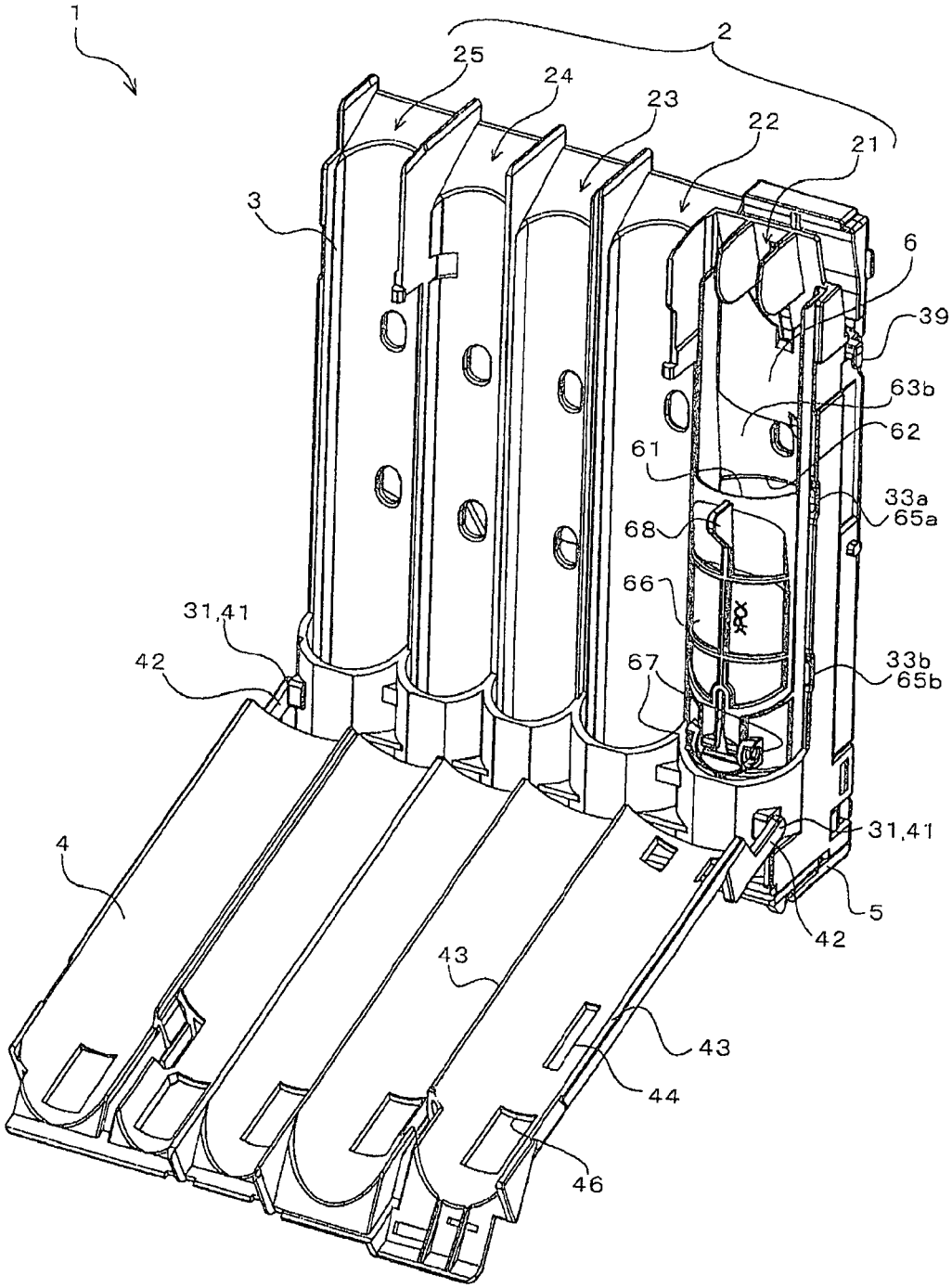
FIG. 2B is a back face side perspective showing, in FIG. 1, the state where the cover is widely opened.
Figure 2C:
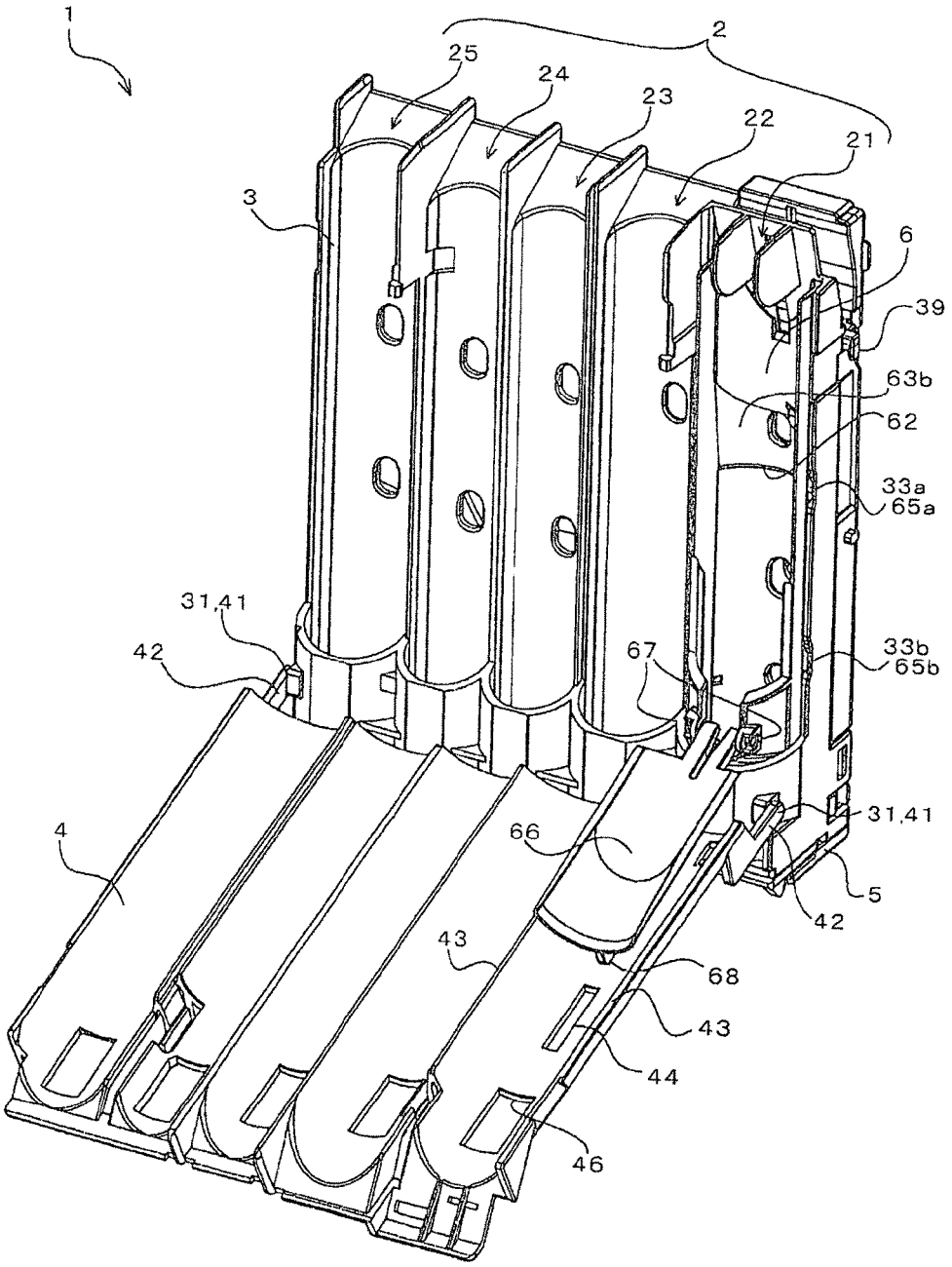
FIG. 2C is a back face side perspective showing, in FIG. 1, the state where the cover and the small cover of the adapter tube are widely opened.

As shown in FIGS. 2A-2C, the cover 4 is supported rotatably to the main body 3 by the engagement between the shafts 31, 31 formed at the lower portion of the main body 3 and the shafts 41, 41 arranged in the cover 4, and, while the cover 4 is closed, the inner wall face of the coin tubes 21-25 is formed by the main body 3, the cover 4, and the inner wall face of the adapter tube 6.

Such a configuration allows the stored coins to be collected not only from the upper edge of the unit tube 2 but also from the back face side, so that the stored coins are collected easily and quickly.

It is noted that the shaft 41 of the cover 4 is mounted to the shaft 31 of the main body 3 by making use of elasticity (elastic return force, etc. of resin material) of the arms 42, 42 having the shaft 41 at the tip.

Figure 3A:
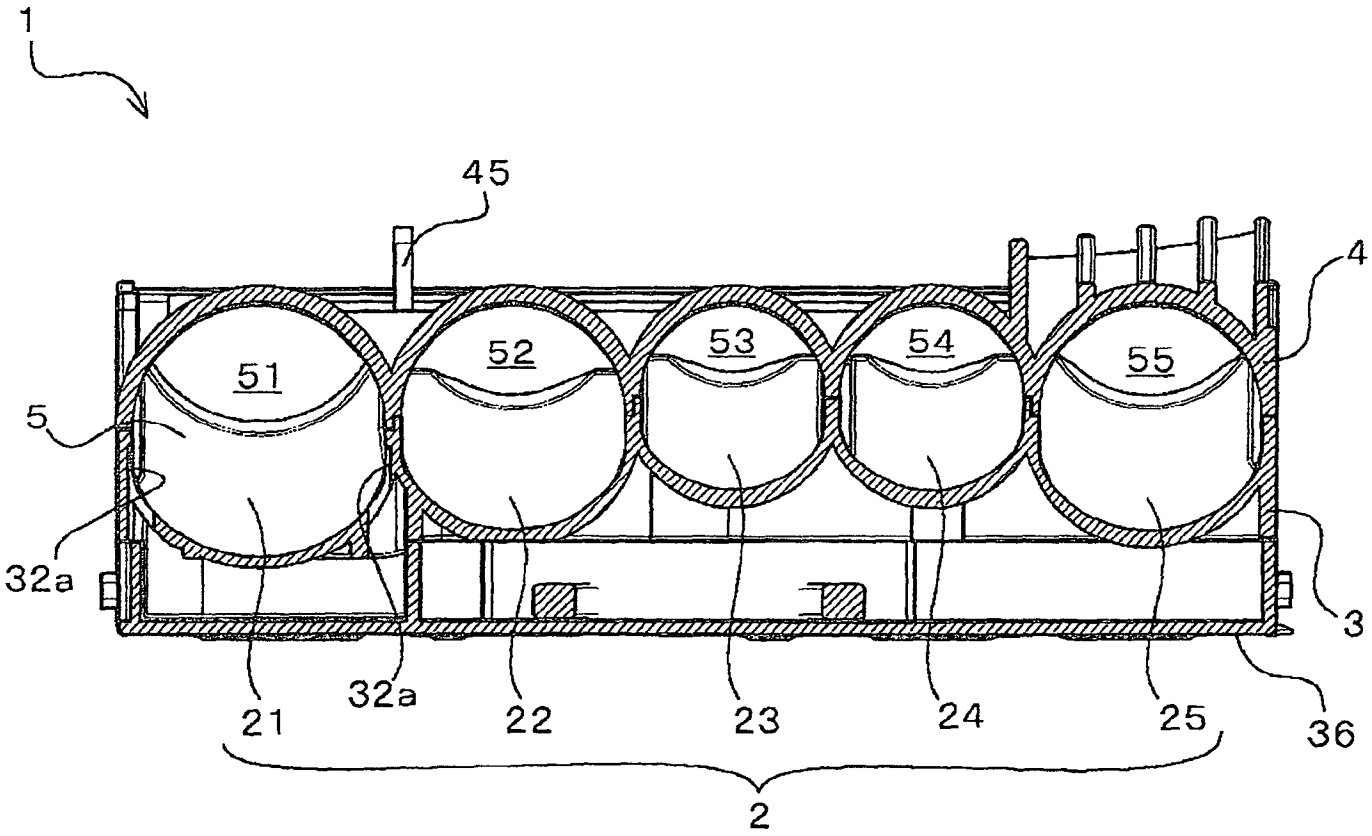
FIG. 3A is a plane cross section plan of the coin storage cassette in the present invention through the upper side groove (32*a*), showing the state where the adapter tube is removed.
Figure 3B:
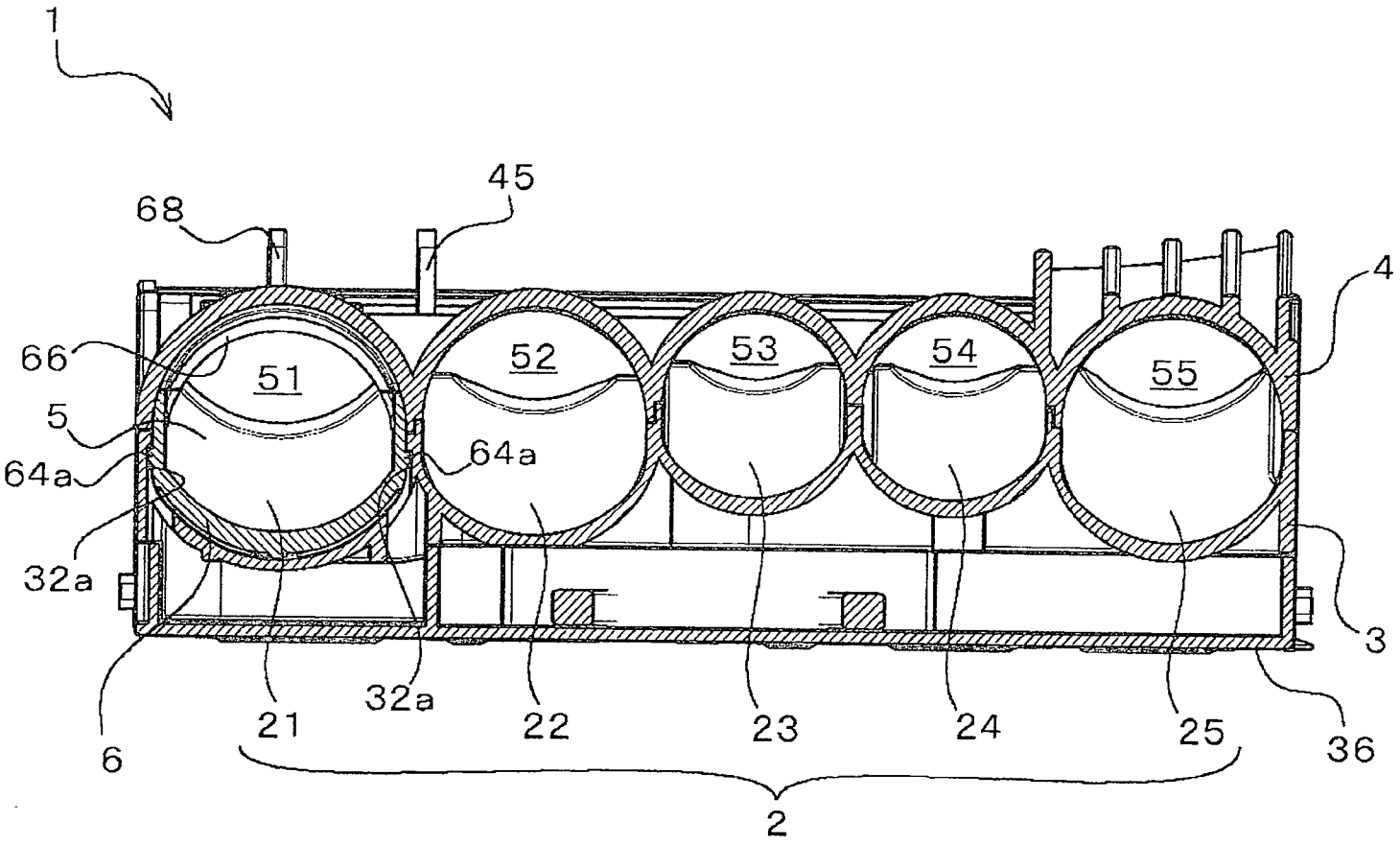
FIG. 3B is a plane cross section plan showing, in FIG. 3A, the state where the adapter tube is mounted.
Figure 3C:
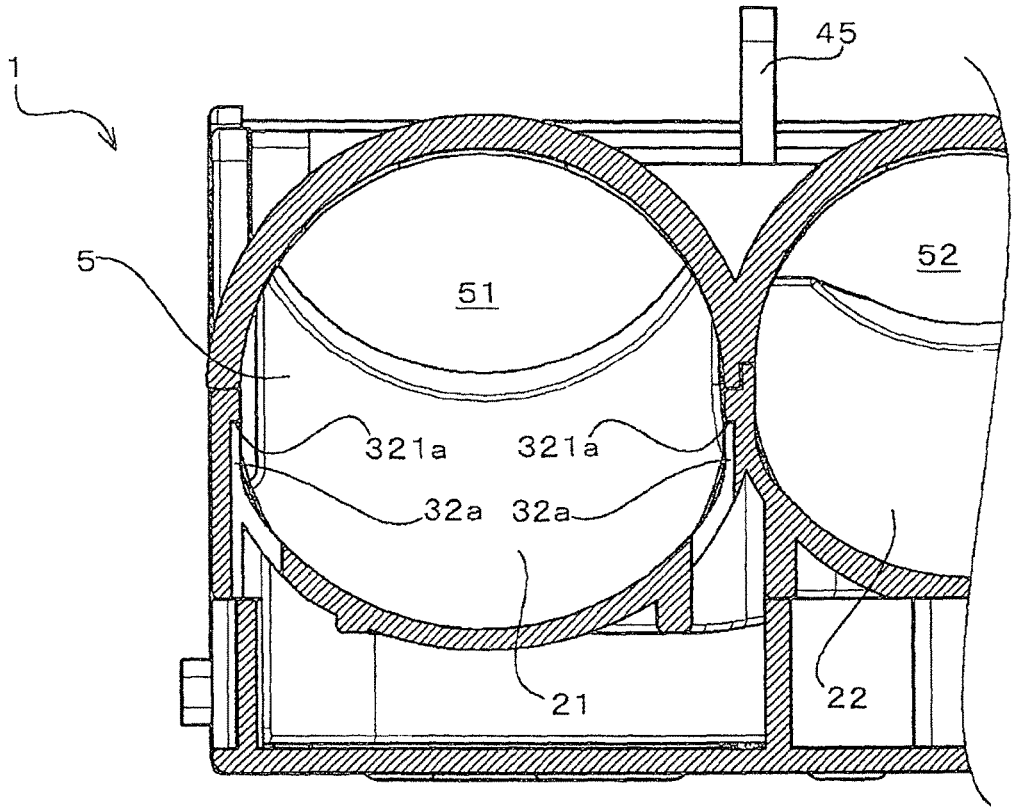
FIG. 3C shows the coin tube (21) partially enlarged in FIG. 3A.
Figure 3D:
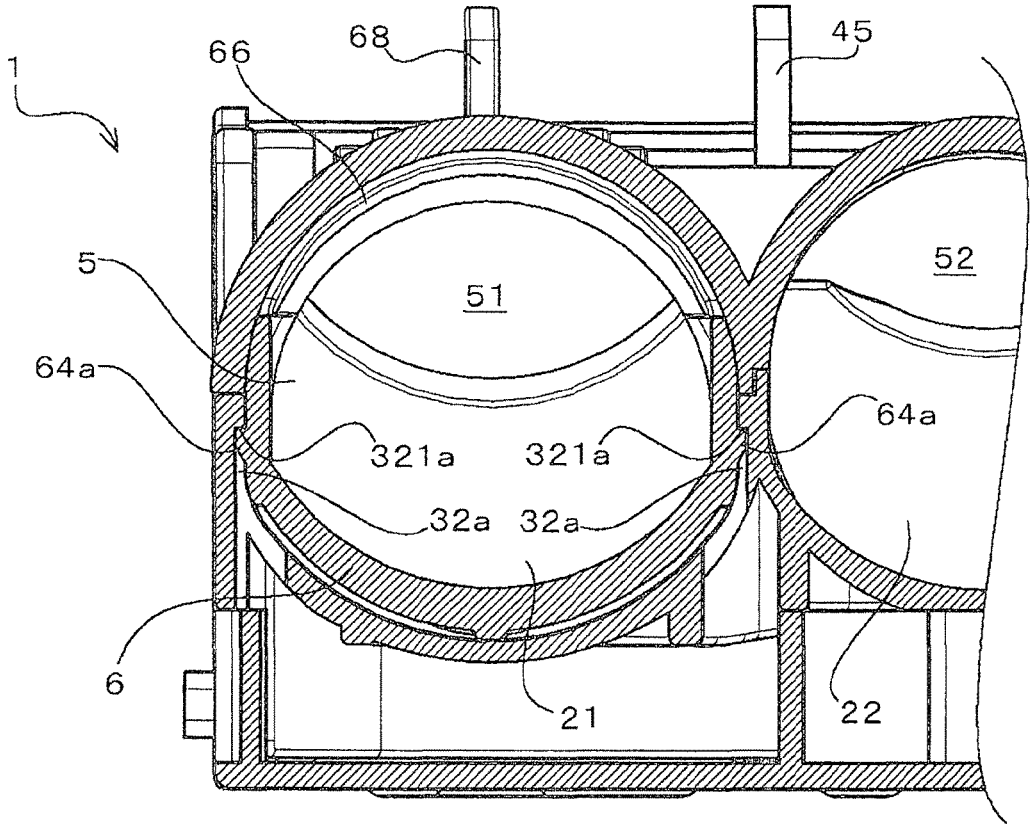
FIG. 3D shows the coin tube (21) partially enlarged in FIG. 3B.

As shown in FIGS. 3A and 3B, in the coin base 5, payout holes 51-55 for dropping the coins extracted backward (upward in the drawings) by a payout slide not shown of a coin payout mechanism not shown in the lower region of the respective coin tubes 21-25 are formed.

The payout holes 51-55 are designed to be sized and positioned so that the coin dropping from above is not hooked between the arced edge of the payout holes 51-55 and the inner wall face of the coin tubes 21-25 and not kept standing.

Figure 4A:
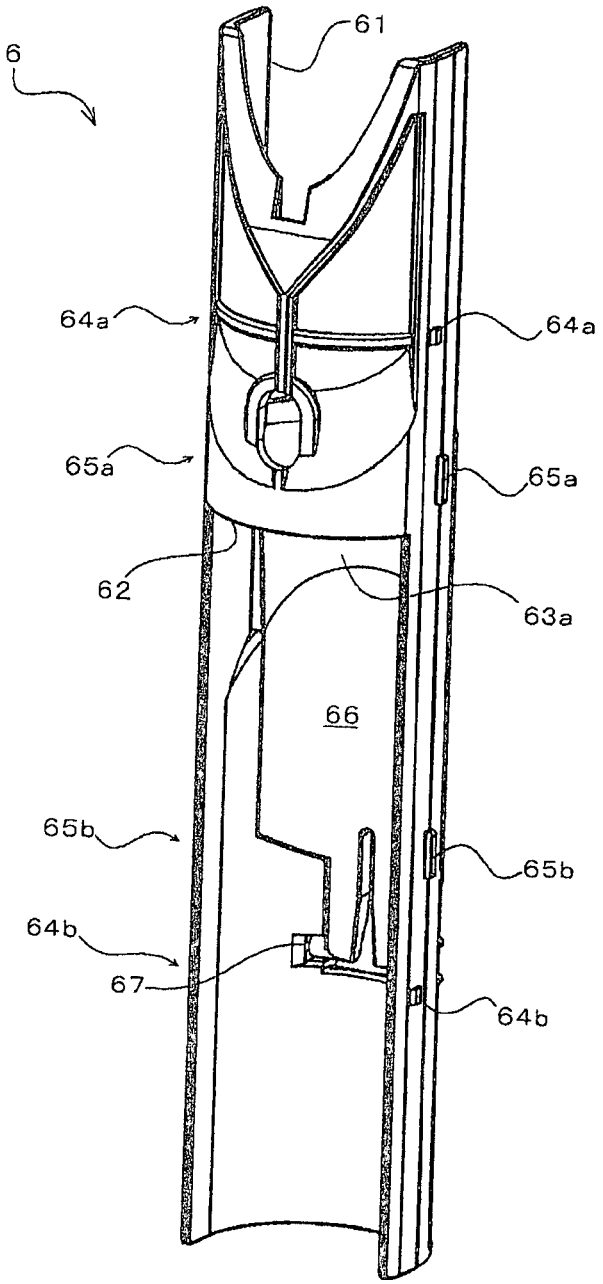
FIG. 4A is a front face side perspective of the adapter tube in the present invention.
Figure 4B:
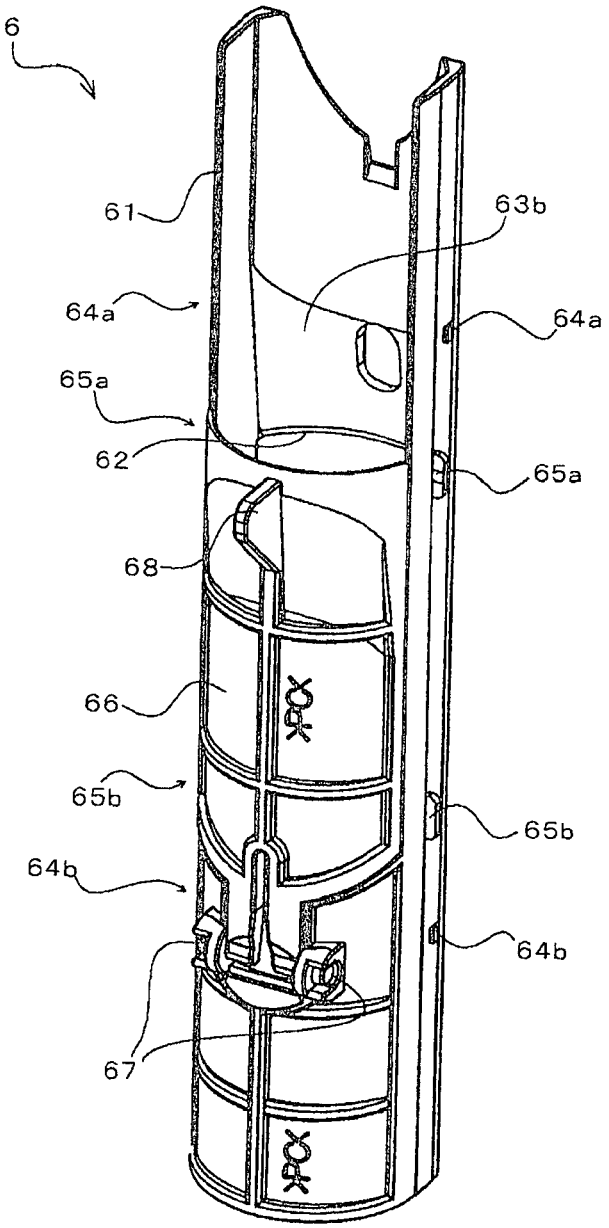
FIG. 4B is a back face side perspective of the adapter tube in FIG. 4A.
Figure 4C:
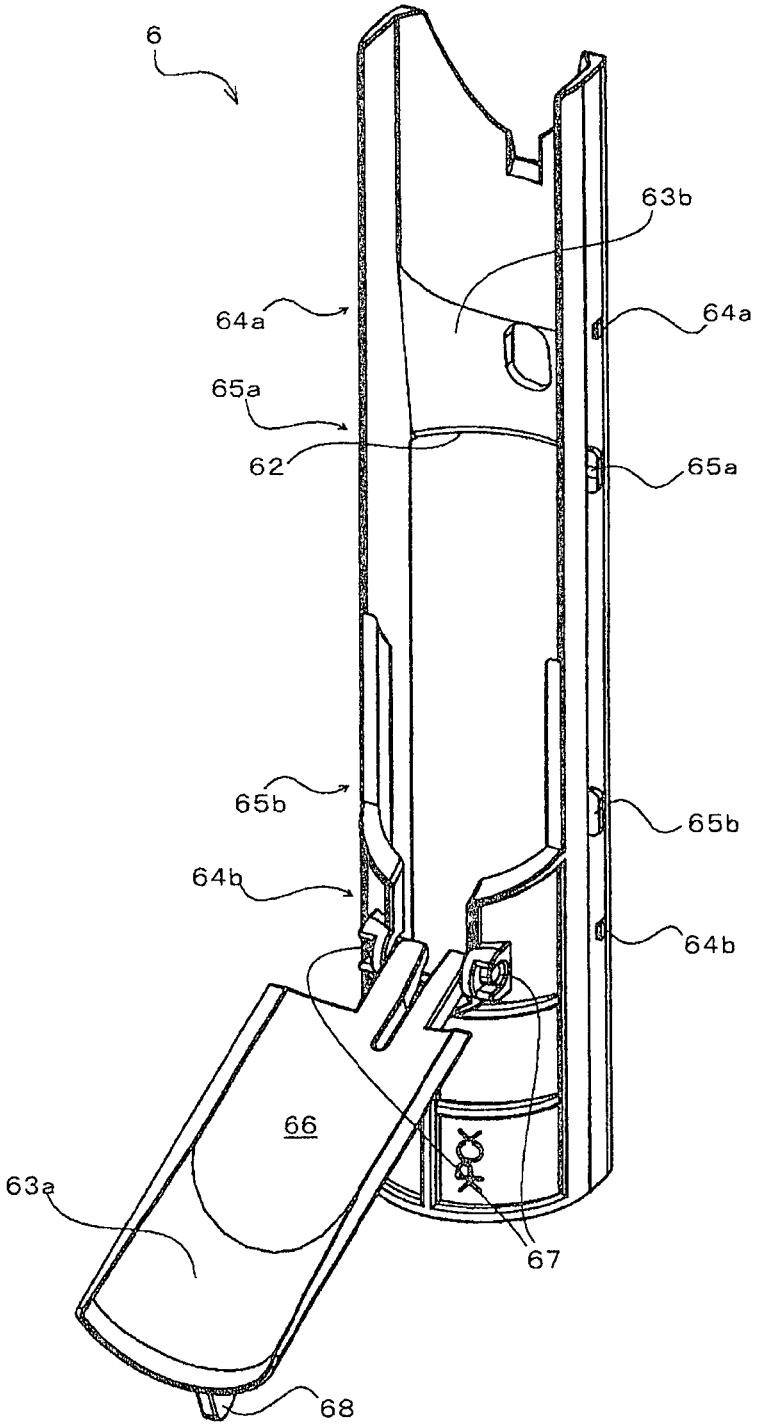
FIG. 4C is a back face side perspective showing, in FIG. 4B, the state where the small cover of the adapter tube is widely opened.
Figure 5A:
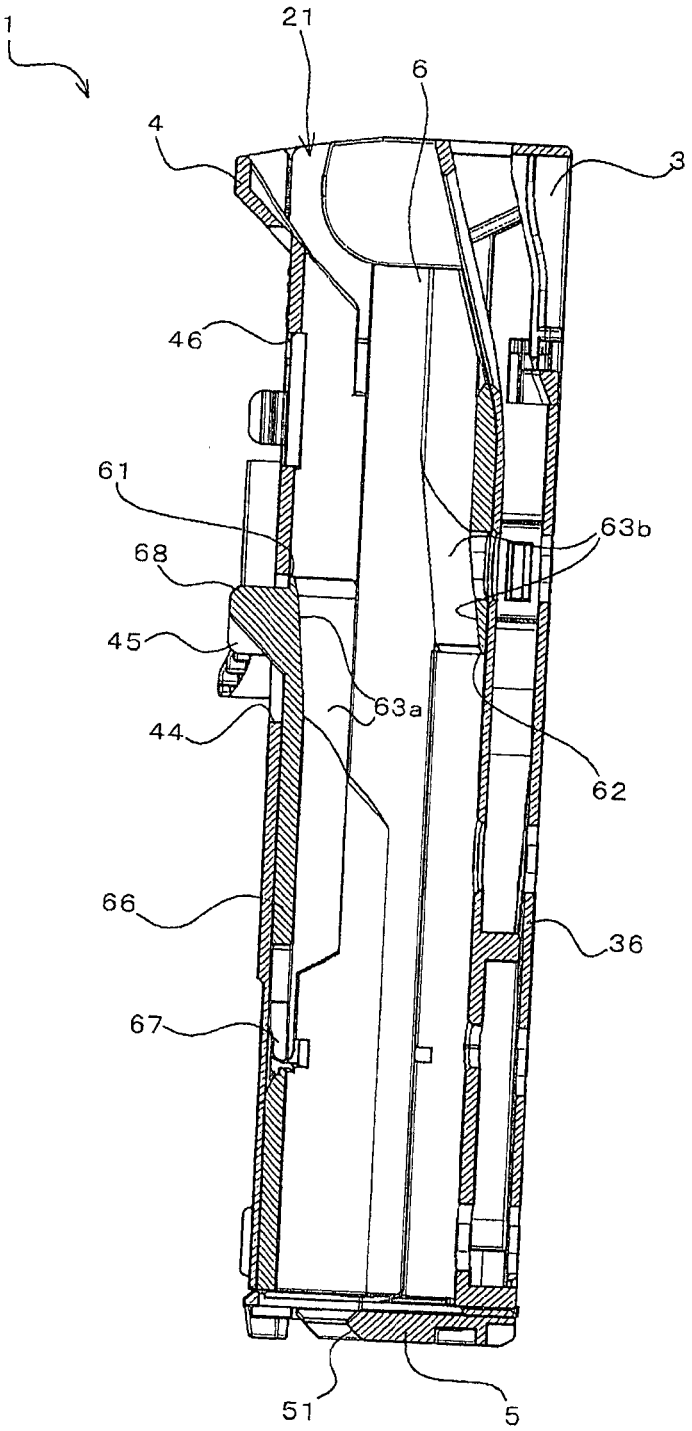
FIG. 5A is a side cross section plan of the coin storage cassette in the present invention through the center of the adapter tube.
Figure 5B:
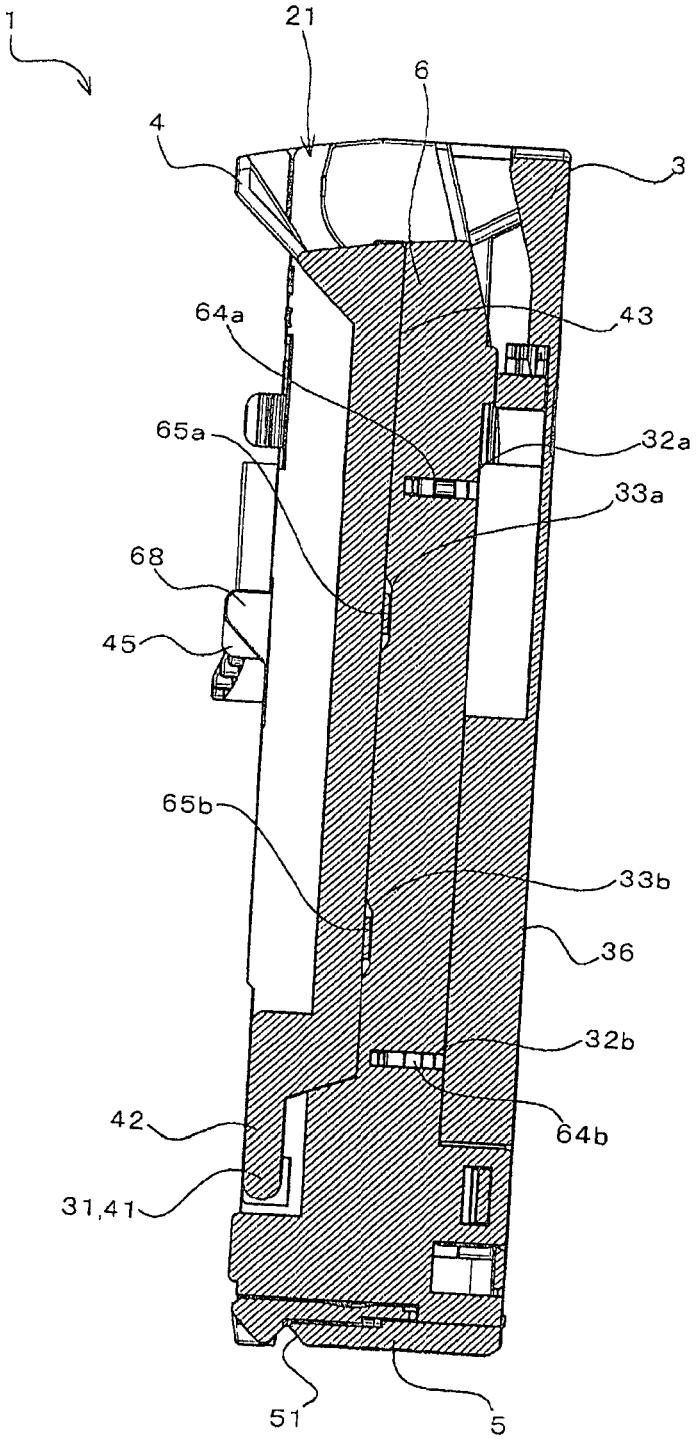
FIG. 5B is a side cross section plan of the coin storage cassette in the present invention through the left edge of the adapter tube.

An adapter tube 6 in the present embodiment is shown in FIGS. 4A-4C. FIG. 4A is a front face side perspective of the adapter tube in the present invention. FIG. 4B is a back face side perspective of the adapter tube. FIG. 4C is a back face side perspective showing, in FIG. 4B, the state where the small cover of the adapter tube is widely opened.

The adapter tube 6 has a substantially cylindrical shape with an outer diameter engaged with the inner diameter of the coin tube 21. A substantially rectangular-shaped upper rear notch 61 is formed on its back face upper side and a substantially rectangular-shaped lower front notch 62 is formed on its front face lower side.

As shown in FIGS. 3B, 4A-4C, 5A, the adapter tube 6 forms an inclined face 63*a* which is communicated with the lower edge of the upper rear notch 61 and an inclined face 63*b* which is communicated with the upper edge of the lower front notch 62. The direction in which the stored coins are guided is gradually changed so that the coins are guided toward the back face side inner wall face of the coin tube 21 in the upper portion and toward the front face side inner wall face of the coin tube 21 in the central and lower portions, with the region where the inclined face 63*a* and the inclined face 63*b* are opposing being the boundary.

Thereby, while the adapter tube 6 is mounted to the coin tube 21, in the upper portion of the coin tube 21, the stored coins are guided toward the side where the full state detection lever 105 and the full state detection sensor 107 (see FIG. 8) are arranged and then, aligned and stored, and thus, even when the adapter tube 6 is mounted, the distance between the stored coins and the full state detection lever 105/the full state detection sensor 107 remains the same compared with the time before the adapter tube 6 is mounted, and the full state detection lever 105 and the full state detection sensor 107 can securely detect the stored coins.

Furthermore, configuring so that the stored coins (with small diameter) inside the coin tube 21 and the adapter tube 6 are guided toward the front face side in the lower portion allows the coins to be guided toward the side opposite to the side where the payout hole 51 is arranged, and then aligned and stored, and thus prevents the situation in which the coins with small diameter are caught while standing at the payout hole 51 and a coin payout failure occurs.

As shown in FIGS. 4A-4C, side projections 64*a*, 64*a*, 64*b*, 64*b* protruding outward are formed horizontally symmetrically, respectively in the upper and lower parts of the opposing side portions near the front face on the outer wall face of the adapter tube 6. Also, respectively two pairs of convexes 65*a*, 65*a*, 65*b*, 65*b* are formed horizontally symmetrically on opposing sides of the outer wall face of the adapter tube 6 below the side projections 64*a*, 64*a* and above the side projections 64*b*, 64*b*.

In contrast, as shown in FIGS. 2A, 3A-3D, 5B, on the inner wall face of the coin tube 21 in the main body 3, the groove-shaped side grooves 32*a*, 32*a*, 32*b*, 32*b* extending in the front-to-rear direction where, when the adapter tube 6 is mounted, the rear edges 321*a*, 321*a* of the side grooves 32*a*, 32*a*, 32*b*, 32*b* are engaged with the side projections 64*a*, 64*a*, 64*b*, 64*b* are formed (no reference numerals for the rear edge of the side grooves 32*b*, 32*b* shown). Also, as shown in FIGS. 1, 2A-2C, 5B, in the edge of the side end of the coin tube 21 in the main body 3, the recesses 33*a*, 33*a*, 33*b*, 33*b* with which the convexes 65*a*, 65*a*, 65*b*, 65*b* are engaged when the adapter tube 6 is mounted are formed.

When the cover 4 is widely opened, the adapter tube 6 is pushed downward of the coin tube 21 while being radially bent and the side projections 64*b*, 64*b* and the side projections 64*a*, 64*a* are engaged respectively with the side grooves 32*b*, 32*b* and the side grooves 32*a*, 32*a*, and thereby the adapter tube 6 is mounted.

In this case, the forward movement of the adapter tube 6 is restricted by the outer wall face at the front of the adapter tube 6 being engaged with the inner wall face of the coin tube 21, and the backward movement is restricted by the rear edges 321*a*, 321*a* (no reference numerals for the rear edge of the side grooves 32*b*, 32*b* shown) of the side grooves 32*a*, 32*a*, 32*b*, 32*b* locking the side projections 64*a*, 64*a*, 64*b*, 64*b*.

Also, the side grooves 32*a*, 32*a*, 32*b*, 32*b* are arranged so as to be in contact as a plate in the upper/lower direction so that the movement in upper/lower direction of the side projections 64*a*, 64*a*, 64*b*, 64*b* are restricted. Furthermore, the side grooves 32*a*, 32*a*, 32*b*, 32*b* are preferably chamfered in the arrangement direction (front-to-rear direction) so as to be arranged smoothly.

Also, while the cover 4 is closed, the convexes 65*a*, 65*a*, 65*b*, 65*b* are arranged so as to be interposed by the recesses 33*a*, 33*a*, 33*b*, 33*b* and the side end edges 43, 43, namely the coin tube 21 side edges in the cover 4.

According to such a configuration, even in the case where the adapter tube 6 is not appropriately set and the convexes 65*a*, 65*a*, 65*b*, 65*b* are floating on the coin tube 21 without being engaged, when the cover 4 is about to be closed, the side end edges 43, 43 come into contact with the convexes 65*a*, 65*a*, 65*b*, 65*b* so that the convexes 65*a*, 65*a*, 65*b*, 65*b* are forcibly engaged into the recesses 33*a*, 33*a*, 33*b*, 33*b*, and thereby the adapter tube 6 can be set to the coin tube 21.

It is noted that the shape and position in which the convexes and the recesses are formed are not limited to what the embodiment example shows, not limited to the combination of a convex shape and a recess shape, and are acceptable in any way as long as, when the cover 4 is about to be closed, the cover 4 comes into contact with the adapter tube 6 allowing the adapter tube 6 to be pushed into the appropriate position and is not prevented from being closed.

As shown above, it is configured so that the adapter tube 6 is securely set in the appropriate position, and, while the adapter tube 6 is mounted to the coin tube 21, the side grooves 32*a*, 32*a*, 32*b*, 32*b* restrict top-to-bottom and front-to-rear movement of the side projections 64*a*, 64*a*, 64*b*, 64*b* so as to restrict the rattle of the adapter tube 6, and thereby, the coins can be securely aligned and stored and a payout failure can be prevented.

When the adapter tube 6 is removed from the coin tube 21, radial direction flexture of the entire adapter tube 6 formed in a substantially cylindrical shape is utilized, and the adapter tube 6 is depressed from right and left, and thereby the side projections 64*a*, 64*a*, 64*b*. 64*b* are detached from the side grooves 32*a*, 32*a*, 32*b*, 32*b*.

Also, as shown in FIGS. 2C, 4C, the adapter tube 6 comprises a small cover 66 which openably/closably covers the back face side of the adapter tube 6, the small cover 66 being rotatably supported around the shaft 67 mounted at the height slightly above the lower edge of the cover 4

When the stored coins inside the unit tube 2 are collected from the back face side of the coin storage cassette 1, the small cover 66 configured to be openable/closeable allows the stored coins inside the adapter tube 6 to be collected as well.

Furthermore, as shown in FIGS. 1, 2B, a pressing projection 68 is formed on the back face side of the small cover 66 of the adapter tube 6 so as to be loosely inserted into the rectangular hole 44 formed on the back face side of the coin tube 21 of the cove 4 to protrude to the back face side of the cover 4, when the cover 4 is closed.

Another explanation will be given later regarding this pressing projection 68, the projection 45 formed at the back face side of the boundary between the coin tubes 21, 22 in the cover 4, and the rectangular hole 46 formed on the upper portion on the back face side of the coin tube 21 in the cover 4.

Figure 6:
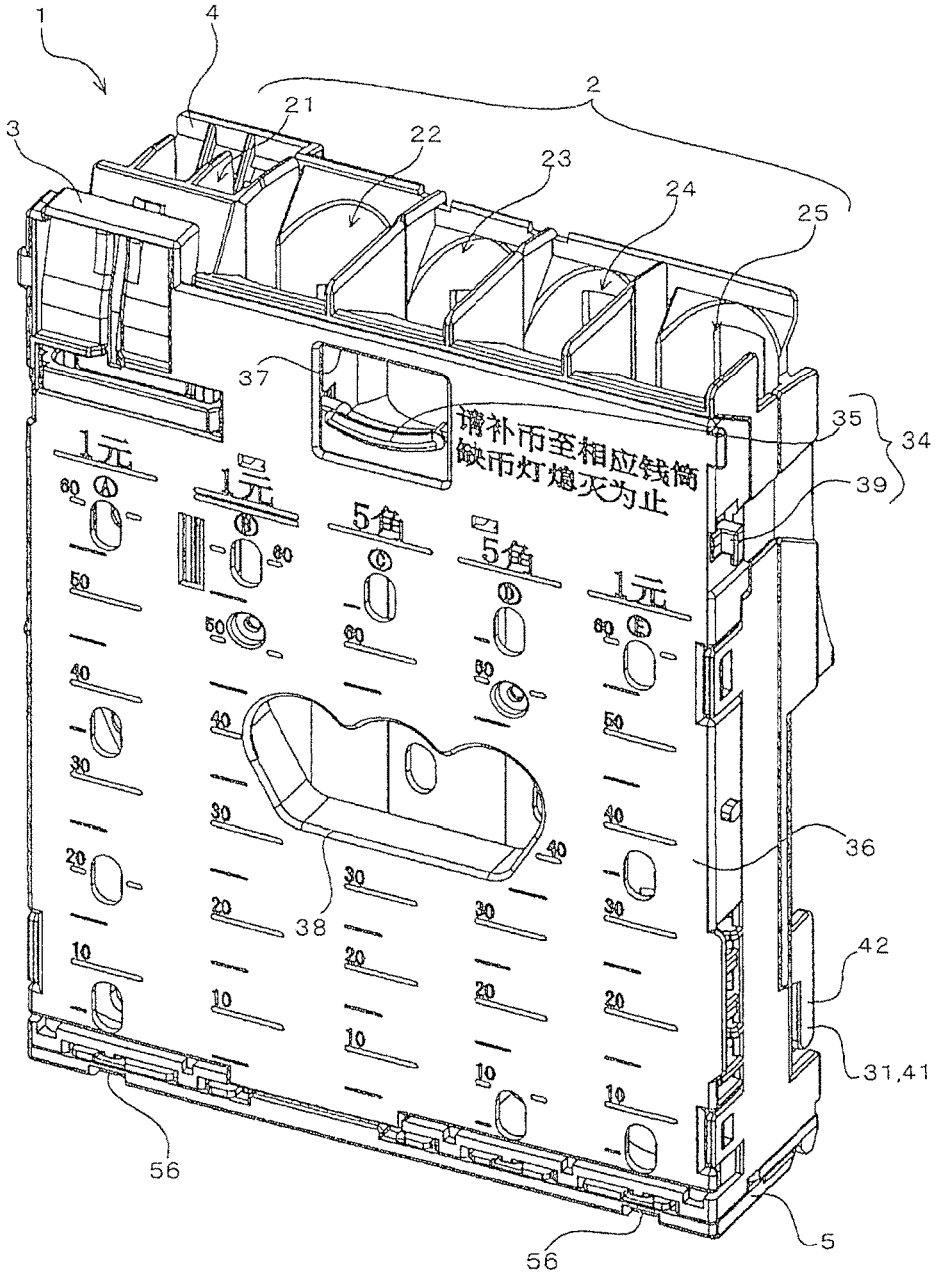
FIG. 6 is a front face side perspective mainly showing the configuration of the front face side of the coin storage cassette in the present invention.

Also, as shown in FIG. 6, the front face side of this coin storage cassette 1 comprises a latching operation portion 35 for operating a latching mechanism 34 which locks/releases the upper portion of the coin storage cassette 1 to/from the main body of the coin handling apparatus 100 (see FIGS. 7A, 7B), and the front cover 36 which covers the front face of the main body 3 comprises an operation hole 37 arranged so as to be capable of operating the latching operation portion 35 and a handle hole 38 which allows fingers to be inserted and hooked at the time of removing and mounting.

Figure 7A:
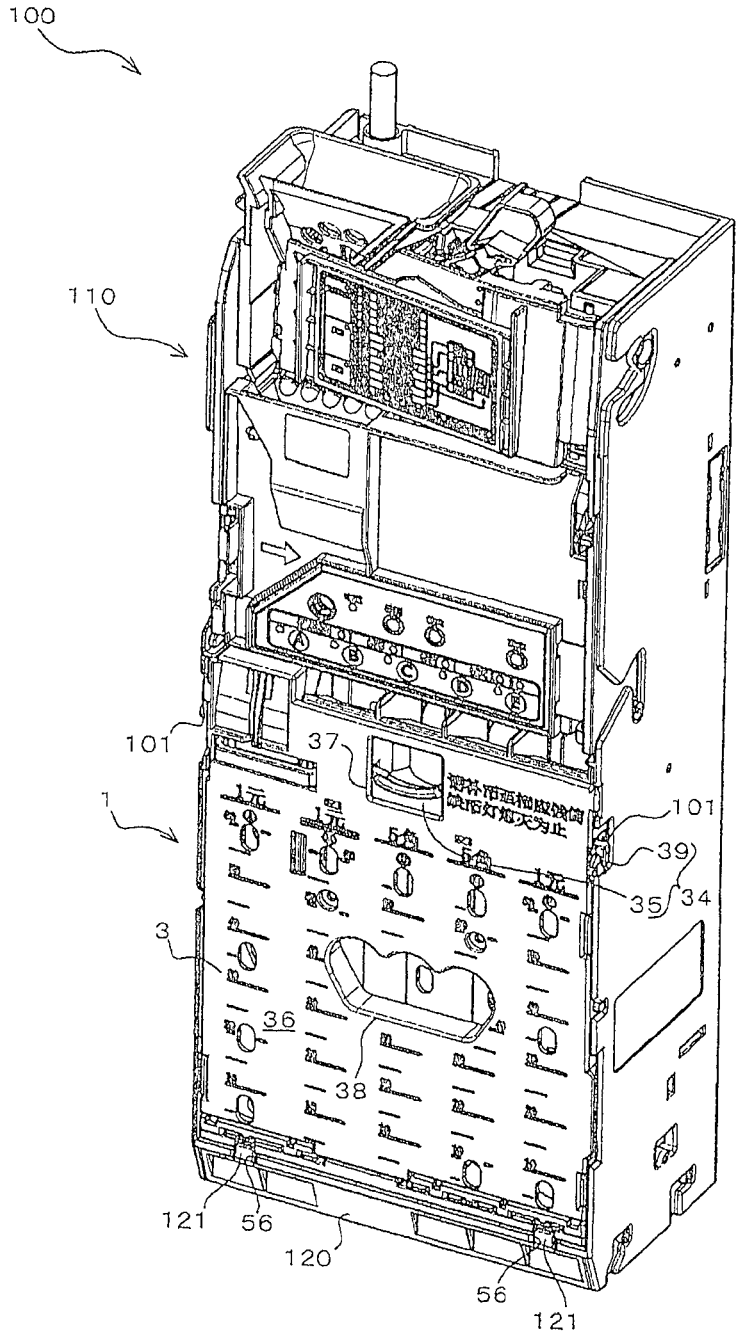
FIG. 7A is a back face side perspective mainly showing the configuration of the back face side of the coin handling apparatus in the present invention.

As shown in FIGS. 7A, 8B, such a coin storage cassette 1 is detachably mounted to the coin handling apparatus 100. Notches 56, 56 formed in the front face of the coin base 5 and exterior stopper hocks 121, 121 formed upward at the upper edge of the front face of a bottom face 120 constituting the lower portion of the coin handling apparatus 100 are engaged, and thereby the lower edge of the front face side is fixed, and furthermore, hook portions 39 39 which are allowed to freely advance/retreat on opposing sides of the upper portion of the main body 3 by the operation of the latch mechanism 34 and the locking portions 101, 101 in the coin handling apparatus 100 main body are engaged, and thereby the upper portion is fixed.

In addition, while a thumb is placed on the latching operation portion 35 through the operation hole 37 and the other fingers are inserted into the handle hole 38, the latching operation portion 35 is depressed downward so that the hook portions 39, 39 are released from the locking portions 101, 101 to release the arrangement between the coin handling apparatus 100 main body and the upper portion, and the coin storage cassette 1 is rotated around the notches 56, 56 and the exterior stopper hook 121, and thereby the coin storage cassette 1 can be removed while the coin handling apparatus 100 is mounted to a not shown apparatus.

Figure 7B:
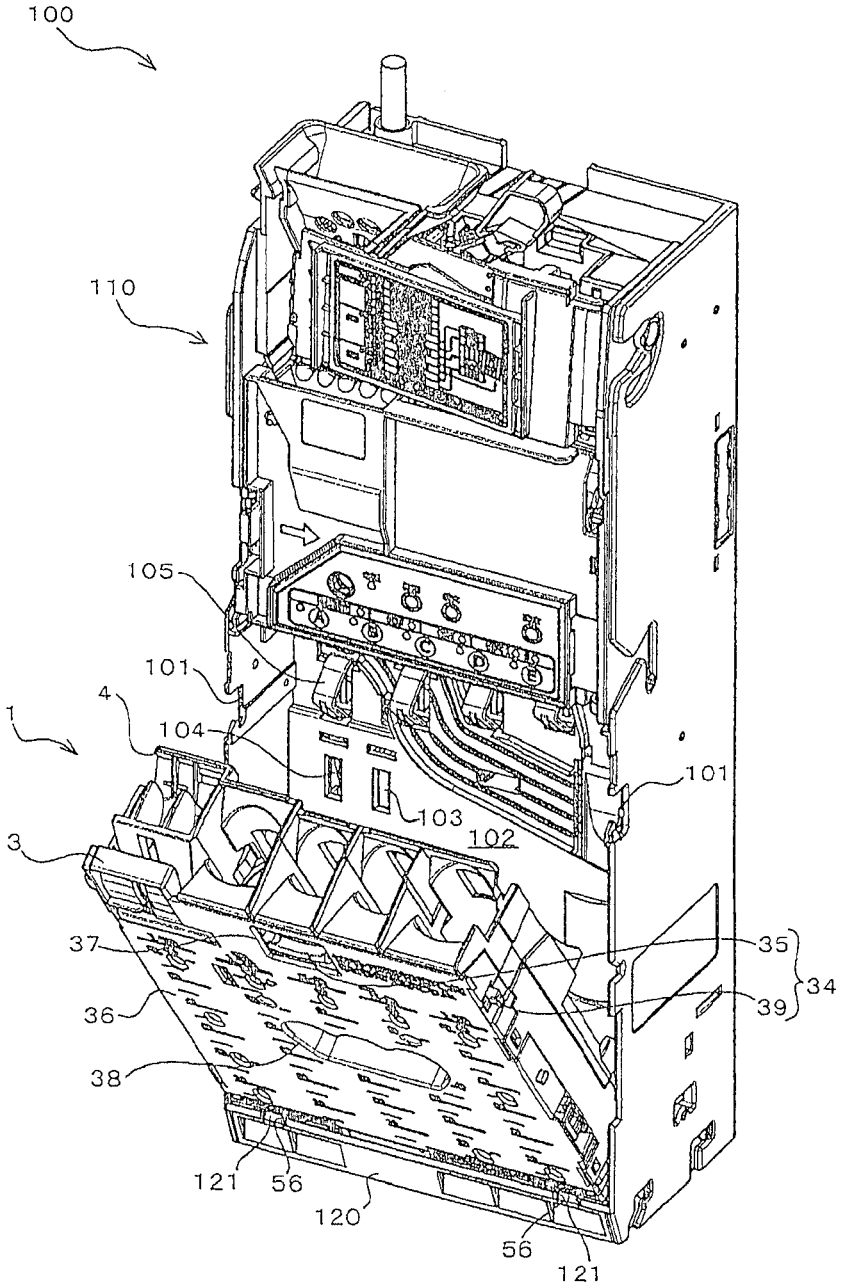
FIG. 7B is a back face side perspective showing, in FIG. 7A, how the coin storage cassette is removed.
Figure 8:
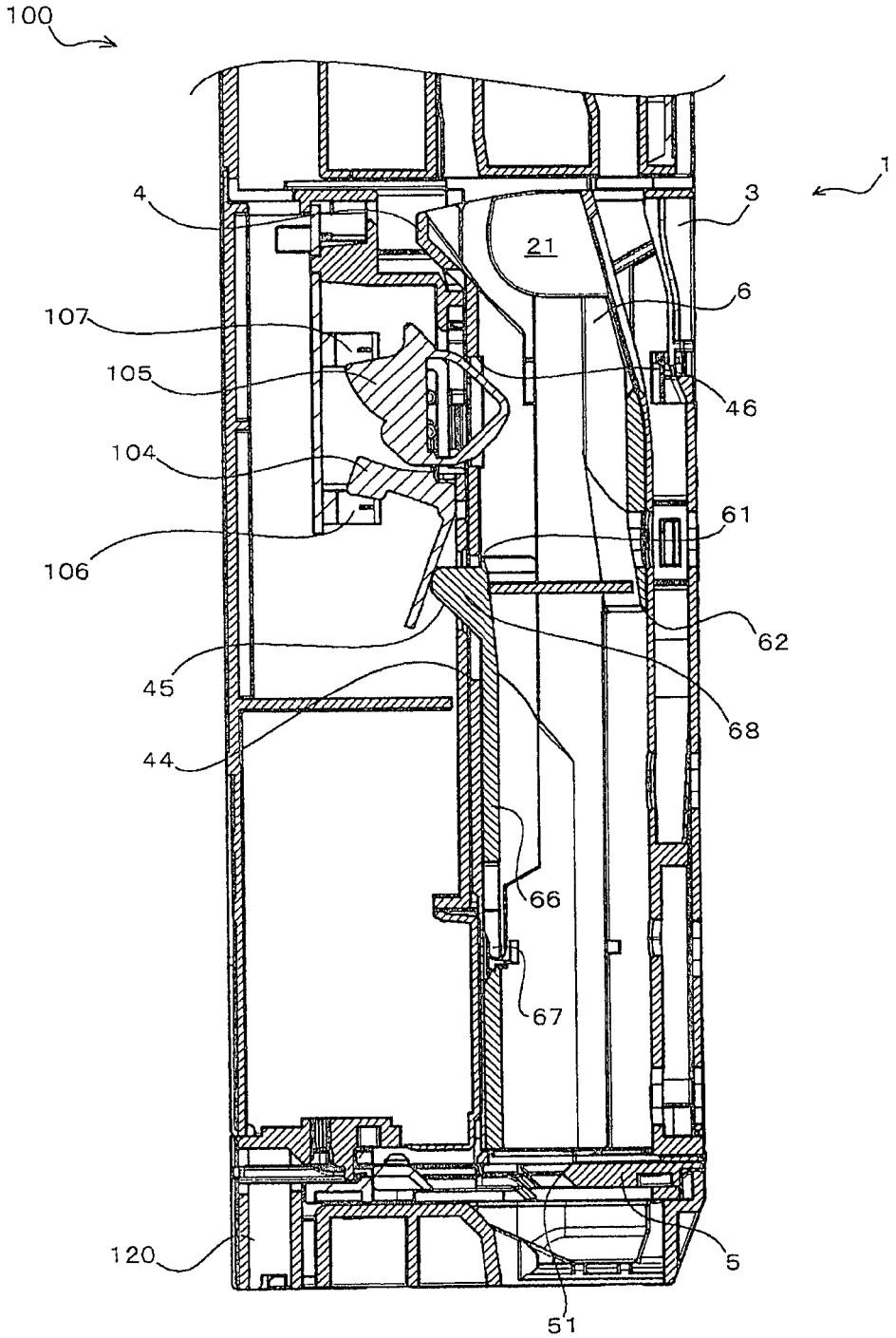
FIG. 8 is a side cross section plan of the coin handling apparatus in the present invention through the center of the adapter tube.

Also, as shown in FIGS. 7B, 8, a mounting detection lever 103, a type detection lever 104, and a full state detection lever 105 which are respectively free-swinging in front-to-rear direction and constantly energized forward are arranged in an opposite face 102 opposite to the back face side of the coin storage cassette 1 of the coin handling apparatus 100.

These levers are arranged in a conventional coin handling apparatus. The mounting detection lever 103 detects if the coin storage cassette 1 is mounted to the coin handling apparatus 100, the type detection lever 104 detects the type (combination of treated denomination) of the mounted coin handling apparatus 100, and the full state detection lever 105 detects when the coin tube 21 gets full inside.

The mounting detection lever 103 and the type detecting lever 104 having substantially L-shaped cross sectional shape are arranged so that the long sides are positioned usually along the opposite face 102 and the levers are swingable backward around a bending part (the mounting detection lever 103 is positioned in the inner part of the type detection lever 104 in FIG. 8, and thus, not shown).

When the coin storage cassette 1 is mounted to the coin handling apparatus 100, the pressing projection 68 of the adapter tube 6 protruding from the rectangular hole 44 of the cover 4 presses the type detecting lever 104 backward, and the projection 45 of the cover 4 presses the mounting detection lever 103 backward, and thereby the type detecting lever 104 and the mounting detection lever 103 swing backward.

Then, the type detection sensor (photo interrupter) 106 and the not shown mounting detection sensor mounted inside the coin handling apparatus 100 respectively detect the motion of the type detection lever 104 and the mounting detection lever 103 (a light non-shielding state is generated), so as to detect that the coin storage cassette 1 is mounted to the coin handling apparatus 100 and the adapter tube 6 is mounted inside the coin tube 21.

As mentioned above, automatically detecting whether or not the adapter tube 6 is mounted to the coin tube 21 allows switch of the denomination of the coins to be stored in the coin tube 21 to be automatically transmitted to the not shown controller of the coin handling apparatus 100, and thereby a failure in which human errors cause the not shown controller to misrecognize the type of the coins inside the coin tube 21 can be prevented.

Also, the full state detection lever 105 is arranged so as to protrude at the upper edge of the coin tube 21 through the rectangular hole 46 of the cover 4, so that, when the stored coins inside the coin tube 21 reach the height of the full state detection lever 105, the full state detection sensor 107 arranged inside the coin handling apparatus 100 detects that the full state detection lever 104 is pressed backward and caused to swing by the stored coins, and thereby it is detected that the coin tube 21 is full inside.

Here, as mentioned above, the upper rear notch 61 is formed in the adapter tube 6 so that the adapter tube 6 does not prevent the full state detection lever 105 from protruding into the coin tube 21.

It is noted that the full state detection lever and sensor are respectively arranged similarly in the coin tubes 22-25, as well.

As mentioned above, in the coin storage cassette in the present invention, top-to-bottom and front-to-rear rattle is prevented by configuring so that the adapter tube is arranged by the engagement of the projections and the grooves.

Also, since it is configured so that guiding the stored coins in the direction opposite to the payout hole at the lower portion of the adapter tube prevents the size of the payout hole relative to the stored coins from being too large, a coin payout failure caused by the coins being caught at the payout hole while standing can be prevented.

Also, guiding the stored coins toward the cover side at the upper portion of the adapter tube allows the full state detection lever of a conventional coin handling apparatus to be kept in use without changing anything.

Also, configuring so that the main body and the cover interpose the convex arranged in the adapter tube allows the adapter tube to be securely set inside the coin tube, and thereby, a coin payout failure caused by a failure to mount the adapter tube appropriately can be prevented.

Also, arranging the small cover which makes the back face of the adapter tube openable/closeable allows the coins inside the adapter tube to be collected from the back face side of the coin storage cassette as well as the conventional unit tube.

Also, The configuration in which the pressing projection arranged in the adapter tube can press a type detection lever of a conventional coin handling apparatus allows the type detection lever arranged for identifying the type of a coin storage cassette to be kept in use for detecting the presence of the adapter tube without changing anything.

In addition, since the presence of the adapter tube is automatically detected, setting of the type of coins to be stored can be automatically switched without being influenced by human errors.

It is noted that, in the above embodiment, although the coin storage cassette 1 is mounted to the coin handling apparatus 100 having the coin selector 110, the coin storage cassette in the present invention can be mounted to a coin handling apparatus exclusively for paying out with no coin selector, for example, and no restriction is given.

DESCRIPTION OF THE REFERENCE NUMERALS

1 Coin storage cassette
2 Unit tube
21-25 Coin tubes
3 Main body
31 Shaft
32 Side groove
321 Rear edge of side groove
33 Recess
34 Latching mechanism
35 Latching operation portion
36 Front cover
37 Operation hole
38 Handle hole
39 Hook portion
4 Cover
41 Shaft
42 Arms
43 Side end edge
44 Rectangular hole
45 Projection
46 Rectangular hole
5 Coin base
51-55 Payout holes
56 Notch
6 Adapter tube
61 Upper rear notch
62 Lower front notch
63 Inclined face
64 Side projection
65 Convex
66 Small cover
67 Shaft
68 Pressing projection
100 Coin handling apparatus
101 Locking portion
102 Opposite face
103 Mounting detection lever
104 Type detection lever
105 Full state detection lever
106 Type detection sensor (photo interrupter)
107 Full state detection sensor (photo interrupter)
110 Coin selector
120 Bottom base
121 Exterior stopper hook

The invention claimed is:

1. A detachable coin storage cassette which can be detachably mounted to a coin handling apparatus, comprising:

a unit tube formed of a plurality of coin tubes arranged linearly and in parallel so that coins are aligned, piled and stored, a cover which openably/closably covers a back face side of the unit tube, and an adapter tube which is detachable inside at least one of the coin tubes, wherein the adapter tube is substantially cylindrical-shaped, having radial elasticity, on a back face side of which an upper rear notch which is communicated with an upper edge is formed, and on opposing outsides of which at least each one of projection-shaped attachment portions is formed, where the upper rear notch forms an inclined face within the coin tube such that coins are guided along the inclined face toward a back face side inner wall of the at least one of the coin tubes, in the at least one of the coin tubes, a plurality of groove-shaped attachment reception portions are formed, into each of which each of the attachment portions is engaged, and thereby the groove-shaped attachment reception portions restrict top-to-bottom and front-to-rear movement of the adapter tube, and the adapter tube is detachable from a back face side of the coin storage cassette, while the cover is widely opened.

2. The detachable coin storage cassette claimed in claim 1 characterized in that, in a case where the adapter tube is not mounted to an appropriate position inside the coin tube, when the cover is about to be closed, the cover comes into contact with the adapter tube to correct the position of the adapter tube into an appropriate position inside the coin tube.

3. A detachable coin storage cassette which can be detachably mounted to a coin handling apparatus, comprising a unit tube formed of a plurality of coin tubes arranged linearly and in parallel so that coins are aligned, piled and stored, a main body which constitutes a front face side of the unit tube, a cover which openably/closably covers a back face side of the unit tube, and an adapter tube which is detachable inside at least one of the coin tubes, wherein the adapter tube is substantially cylindrical-shaped, on a back face side of which an upper rear notch which is communicated with an upper edge is formed and in the front face side of which a lower front notch which is communicated with a lower edge is formed, where the upper rear notch forms an inclined face within the coin tube such that coins are guided along the inclined face toward a back face side inner wall of the at least one of the coin tubes, in the lower portion the coins are guided forward, and where the direction in which the coins are guided is changed in the middle of the adapter tube.

4. The detachable coin storage cassette claimed in claim 3 characterized in that the adapter tube comprises a small cover which is continuous to the lower edge of the upper rear notch and openably/closably covers the back face side of the adapter tube.

5. The detachable coin storage cassette claimed in claim 3 characterized in that, a rectangular hole is formed on a back face side of the at least one of the coin tubes, in the small cover of the adapter tube, a projection for detecting the adapter tube which is protrudingly provided backward and protrudes backward of the coin storage cassette through the rectangular hole is formed, and the projection for detecting the adapter tube, when the coin storage cassette is mounted to the coin handling apparatus, activates detecting means which is arranged in the coin handling apparatus and detects a type of the mounted coin storage cassette.

* * * * *